US005765339A

United States Patent [19]

Garland

[11] Patent Number: 5,765,339

[45] Date of Patent: Jun. 16, 1998

[54] DIAPER PAIL

[76] Inventor: Thomas A. Garland, 76 Reservoir Cir., Jamestown, R.I. 02835

[21] Appl. No.: 854,653

[22] Filed: May 12, 1997

Related U.S. Application Data

[60] Division of Ser. No. 518,824, Aug. 24, 1995, abandoned, which is a continuation-in-part of Ser. No. 297,250, Aug. 26, 1994, Pat. No. 5,651,231.

[51] Int. Cl.[6] ..... B65B 5/10

[52] U.S. Cl. ..... 53/258; 53/260; 53/390; 53/244; 53/248; 220/908; 220/263

[58] Field of Search ..... 4/484; 53/243, 53/244, 248, 255, 258, 259, 260, 284.7, 390, 392, 459, 469, 475, 567, 511, 512, 550, 551, 553, 554, 570, 576; 206/366, 370; 215/311, 312, 313; 220/908, 404, 203.05, 203.06, 252, 253, 254, 263; 452/42

[56] References Cited

U.S. PATENT DOCUMENTS

| | | | |
|---|---|---|---|
| 148,211 | 5/1874 | Haven | 452/42 |
| 736,720 | 8/1903 | Hahn | 452/42 |
| 1,238,010 | 8/1917 | Fisher . | |
| 1,333,051 | 3/1920 | Young . | |
| 1,527,870 | 2/1925 | Hansman | 452/42 |
| 1,638,360 | 8/1927 | Olson . | |
| 1,788,958 | 1/1931 | Polk | 53/258 |
| 1,982,917 | 12/1934 | Lothrop et al. | 215/313 X |
| 2,671,906 | 3/1954 | Potts | 53/548 X |
| 3,321,103 | 5/1967 | Phillips | 53/469 X |
| 3,322,477 | 5/1967 | Armijo | 53/570 X |
| 3,452,368 | 7/1969 | Couper | 53/567 X |
| 3,648,302 | 3/1972 | Winters | 4/484 |
| 3,665,522 | 5/1972 | Backlund et al. | 4/484 |
| 3,693,193 | 9/1972 | May | 4/484 |
| 3,723,999 | 4/1973 | Miller | 4/484 |
| 3,749,274 | 7/1973 | Mele et al. | 220/87.1 X |
| 3,878,572 | 4/1975 | Eriksson | 4/484 |
| 3,935,692 | 2/1976 | Miller | 53/390 X |
| 4,025,969 | 5/1977 | Dahlen | 4/484 |
| 4,416,197 | 11/1983 | Kehl | 220/908 X |
| 4,427,110 | 1/1984 | Shaw | 206/205 |
| 4,519,104 | 5/1985 | Nilsson | 4/484 |
| 4,736,860 | 4/1988 | Bemis . | |
| 4,779,728 | 10/1988 | Hanifl et al. . | |
| 4,828,107 | 5/1989 | Spencer | 220/908 X |
| 4,869,049 | 9/1989 | Richards et al. . | |
| 4,890,733 | 1/1990 | Anderson . | |
| 4,924,919 | 5/1990 | Oyler | 53/469 X |
| 5,035,671 | 7/1991 | Anderson et al. | 452/42 X |
| 5,046,614 | 9/1991 | Torres et al. . | |
| 5,076,429 | 12/1991 | Patrick et al. | 220/908 X |
| 5,147,055 | 9/1992 | Samson et al. . | |
| 5,158,199 | 10/1992 | Pontius | 220/470 X |
| 5,385,259 | 1/1995 | Bernstein et al. | 220/908 X |
| 5,535,913 | 7/1996 | Asbach et al. | 220/908 X |

OTHER PUBLICATIONS

Turn 'n Seal Diaper Pail advertisement (Oct. 22, 1994).

1994 Mondial Industries, Limited Diaper Genie advertisement.

*Primary Examiner*—Daniel Moon

*Attorney, Agent, or Firm*—Salter & Michaelson

[57] ABSTRACT

A container receives and stores soiled items through valving structure that receives a soiled item through a normally open input opening and releases the soiled item to the container through a normally closed output opening after closing the normally open input opening and opening the normally closed output opening while preventing odors inside the container from escaping to the region outside the container.

1 Claim, 13 Drawing Sheets

DIAPER PAIL

This application is a divisional patent application of application Ser. No. 08/518,824, filed Aug. 24, 1995, now abandoned, which is a continuation-in-part application of application Ser. No. 08/297,250 filed Aug. 26, 1994, now U.S. Pat. No. 5,651,231.

BACKGROUND OF THE INVENTION

The present invention relates in general to pumping, valving, and storaging, and more particularly concerns apparatus for moving material from one location to another.

A search of subclasses 252, 254, 262, 263, 331, 334, 343, 904 and 908 of class 220 and subclass 37 of D32 identified U.S. Pat. Nos. 5,147,055; 5,046,614; 4,890,733; 4,779,728; 4,736,860; 1,638,360; 1,333,051; and 1,238,010, which furnish background for the invention.

SUMMARY OF THE INVENTION

According to the invention a container receives and stores soiled items through valving structure that receives a soiled item through a normally open input opening and releases the soiled item to the container through a normally closed output opening after closing the normally open input opening and opening the normally closed output opening while preventing odors inside the container from escaping to the region outside the container.

According to one aspect of the invention, a piston is sized to slide along a first axis within a hollow cylinder, and the piston and cylinder assembly is rotatable about a second axis with respect to a support structure.

Among other advantages of this aspect of the invention, an article or volume of material may be placed into the cylinder, the cylinder rotated about the second axis to a different orientation, and the piston slid along the first axis to eject the article or material from the cylinder. In this manner, the invention allows material to be moved or pumped from one region to another.

In one embodiment of this aspect of the invention, the cylinder, which has two open ends, is housed in a drum having a partially circular cross section along the second axis (which lies substantially perpendicular to the first axis). The piston is retained in the cylinder by rings disposed in the open cylinder ends, and a seal disposed between the piston and the cylinder reduces leakage therebetween. Typically, a portion of the drum surface is spherical.

A shroud supported by the support structure is disposed adjacent the drum, and a seal (e.g., a foam sheet and/or an o-ring) lies in the gap between the two. A hole in the shroud of substantially the same diameter as the cylinder is located such that the cylinder aligns with the hole when the drum is rotated about the second axis. A snout surrounding the shroud hole is sized to wedge into another hole in a bag retaining member, thereby trapping the mouth region of a bag between the hole and the snout. Together, the drum and shroud comprise a cover assembly that rotatably mounts to the container.

According to another aspect of the invention, a container is sized to receive a bag having a mouth larger than a characteristic cross section of an article to be deposited therein. A member supported by the container has a hole sized in accordance with the characteristic cross section of the article, and the mouth of the bag is releasably secured to the hole so that the bag is gathered to provide an opening into the bag sized in accordance with the characteristic cross section of the article.

Among other advantages of this aspect of the invention, reducing the opening of the bag to reflect the characteristic cross section of the article to be deposited therein makes the bag easier to seal. Moreover, if the gathered opening of the bag is sufficiently small, the bag may be grasped, sealed, and removed with a single hand, facilitating bag removal and replacement.

BRIEF DESCRIPTION OF THE DRAWINGS

Numerous other features, objects, and advantages of the invention will become apparent from the following detailed description when read in connection with the accompanying drawings, in which.

DESCRIPTION OF THE PREFERRED EMBODIMENTS

Figure 1:
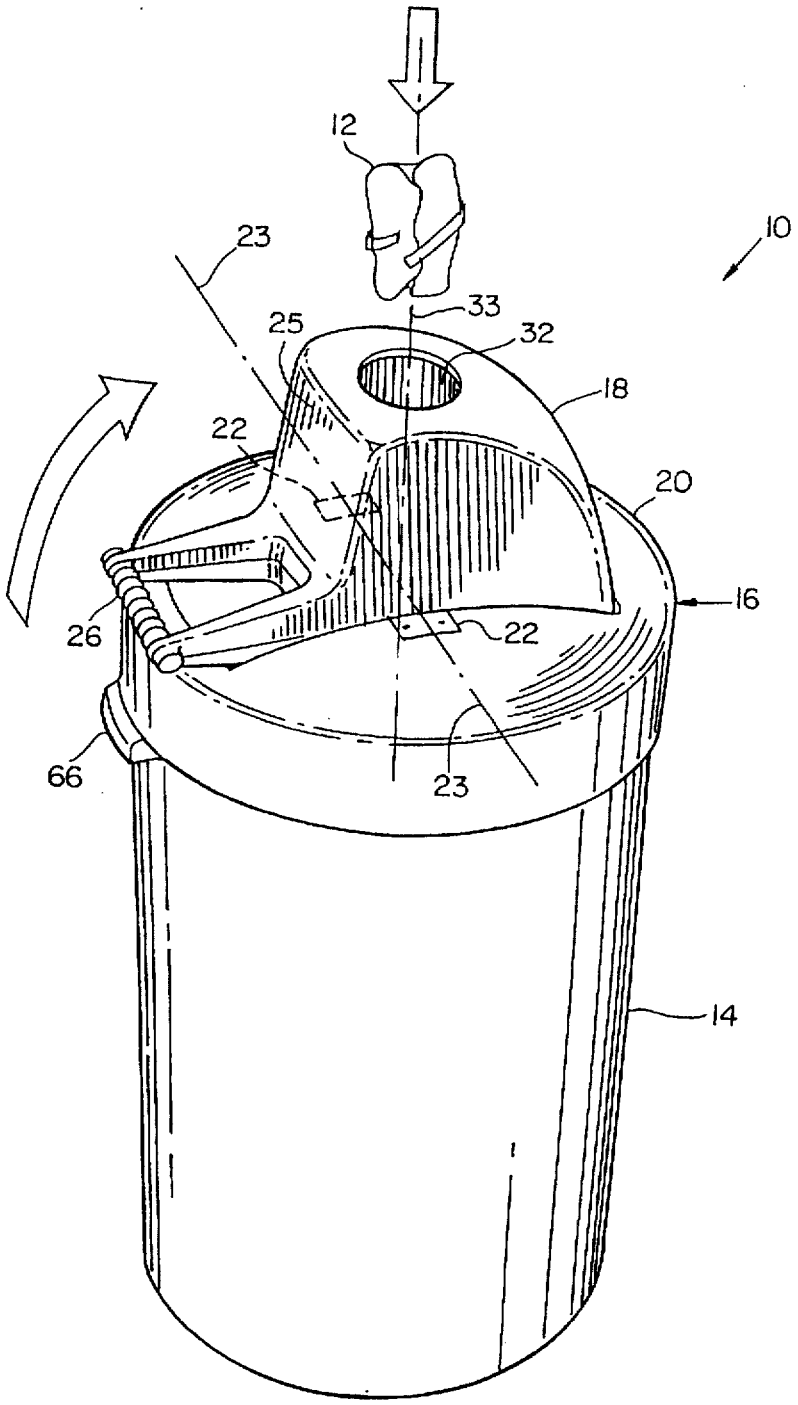
FIG. 1 is a perspective view of a diaper pail.
Figure 2:
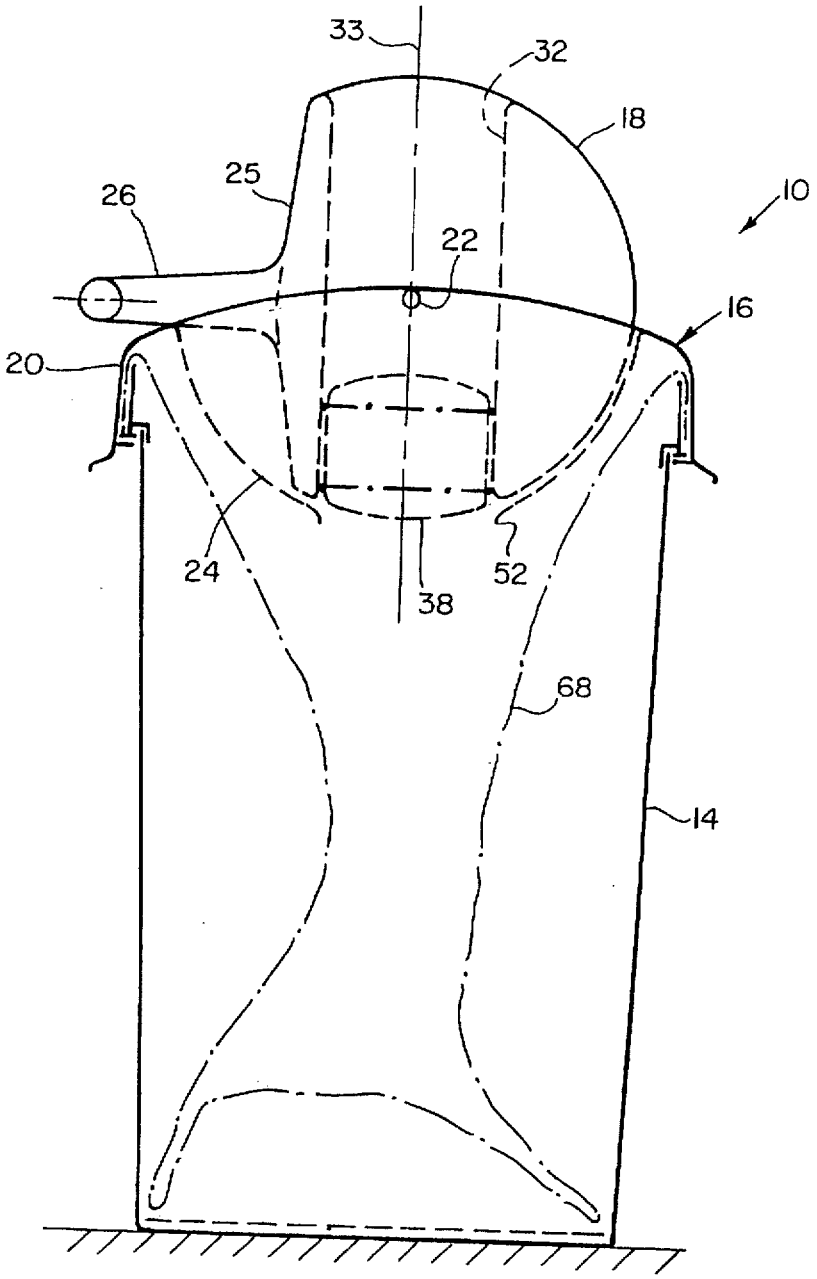
FIG. 2 is a cutaway side view of the diaper pail shown in FIG. 1.

With reference now to the drawings and more particularly to FIGS. 1 and 2, there are shown perspective and cutaway views, respectively, of an exemplary embodiment of the invention, a pail 10 for disposing of and storing, e.g., soiled diapers 12. Pail 10 includes a container 14 and a cover assembly 16 that releasably attaches to container 14. The fit between container 14 and cover assembly 16 is sufficiently close that, with cover assembly 16 in place, container 14 is essentially airtight.

Cover assembly 16 includes a drum 18 and a lid 20. A pair of hinge joints 22 having coaxial axes of rotation 23 attach drum 18 to lid 20, allowing drum 18 to be rotated about axis 23 with respect to lid 20, in the manner indicated in FIG. 1. Drum 18 has a generally uniform, partially circular cross-section along axis 23. Thus, drum 18, an otherwise generally cylindrical member, has a flat spot 25 oriented parallel to axis 23. A handle 26 projecting from flat spot 25 facilitates the rotation of drum 18 about axis 23. The flat spot 25 is aesthetic and is not necessary.

Figure 3A:
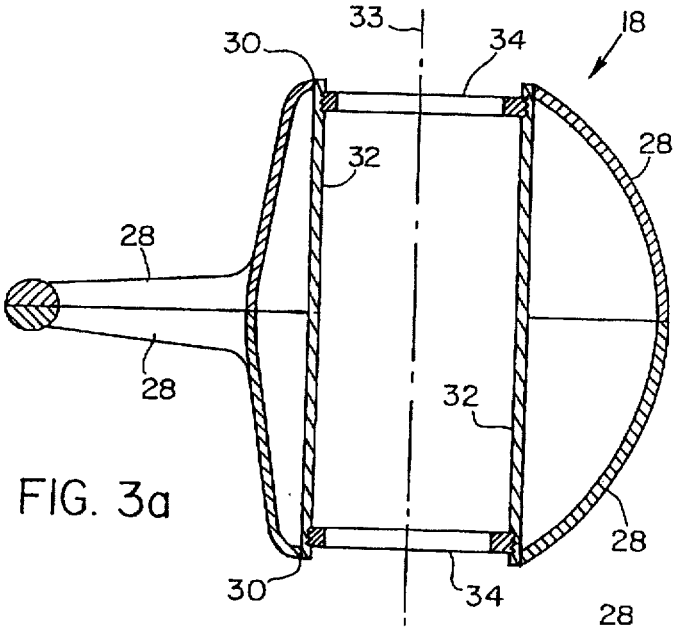
FIGS. 3*a* and 3*b* are cutaway side views of drums for use with the diaper pail shown in FIG. 1.
Figure 3B:
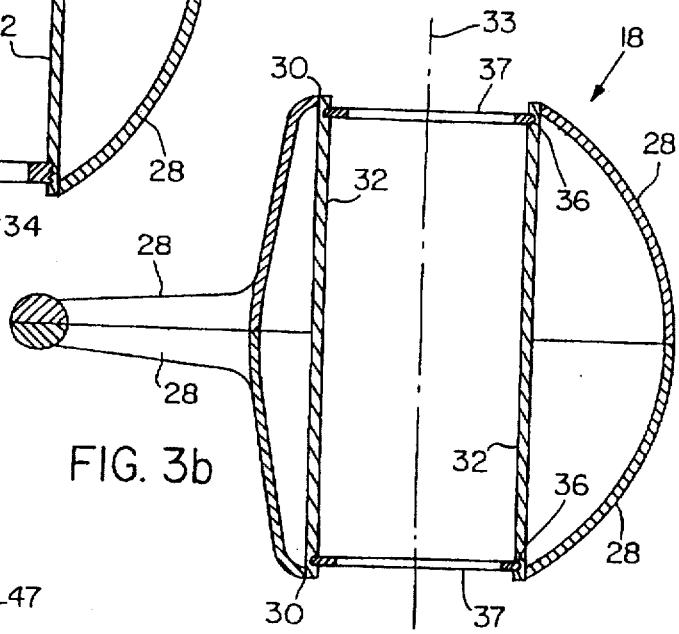

As shown in FIG. 3*a*, drum 18 comprises two substantially identical half-drum sections 28 molded from, e.g., plastic, and bonded or otherwise fastened together. Each of sections 28 has a hole 30 positioned to receive a cylinder 32. Cylinder 32, which is bonded to half-drum sections 28, has a longitudinal axis 33 perpendicular to axis 23. Cylinder 32, a continuous section of, e.g., polyvinyl chloride or other plastic pipe, is threaded at both ends to receive threaded insert rings 34. The inner diameters of both cylinder 32 and insert rings 34 are large enough to accommodate diaper 12. Alternatively, as shown in FIG. 3*b*, a snap-ring gland 36 may be provided at each end of cylinder 32 to receive a snap ring 37.

The outer diameter of a piston 38 disposed in cylinder 32 is slightly smaller than the inner diameter of cylinder 32, and slightly larger than the inner diameter of insert rings 34. Piston 38 is thus free to slide within cylinder 32 along axis 33, but is prevented from escaping by insert rings 34. As shown in FIG. 4*a*, a pair of o-rings 40 or other type of ring seal seated in o-ring glands 41 around the circumference of piston 38 seal piston 38 with respect to cylinder 32. Piston 38 further includes a weight 42, which is selected such that the combined weight of piston 38 and weight 42 is sufficient to cause piston 38 to travel to the point of lowest gravitational potential energy in cylinder 32.

Figure 4B:
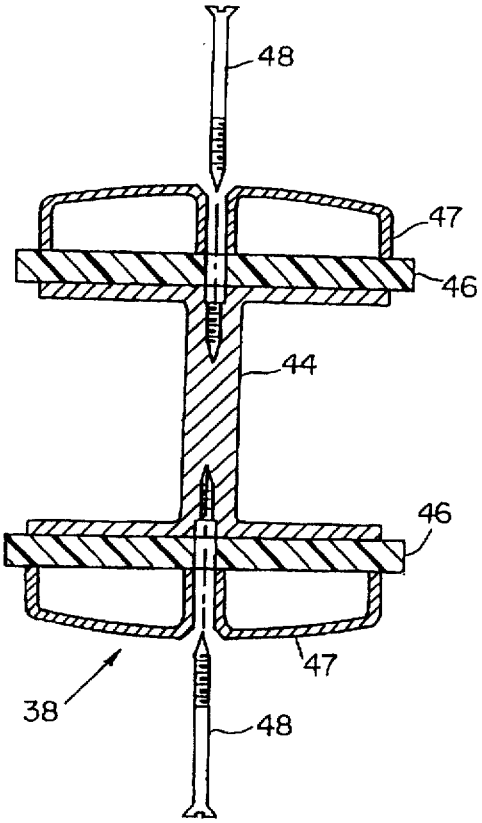
FIGS. 4*a* and 4*b* are cutaway side views of pistons for use with the diaper pail shown in FIG. 1.
Figure 4A:
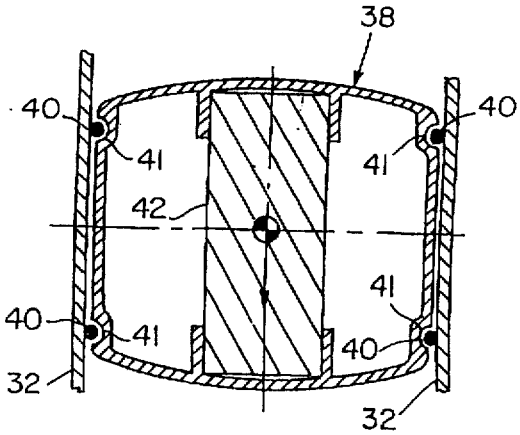

Alternatively, as shown in FIG. 4*b*, piston 38 may include a spool-shaped core 44. Circular wiper seals 46 disposed at opposite ends of core 44 are held in place by end caps 47, which attach to core 44 by screws 48. The outer diameters of core 44 and end caps 47 are slightly smaller than the inner diameter of cylinder 32, and the outer diameters of seals 46 are slightly larger than the inner diameter of cylinder 32. Because seals 46 are disposed between core 44 and end caps 47, tightening screws 48 axially compresses seals 46, increasing their the outer diameter. Thus, the contact force between piston 38 and cylinder 12 (and therefore also the ease with which piston 38 slides within cylinder 32 and the degree of sealing at the piston-cylinder interface) may be adjusted by tightening and loosening screws 48. Any other suitable seal may be used, such as knife-edged wiper seals or piston rings seated in an annular recess of the piston.

Piston 38 is installed into drum 18 by removing one of insert rings 34, inserting piston 38 into cylinder 32, and reinstalling the insert ring 34. Piston 38 may be removed, e.g., for cleaning or replacing seals, by reversing this process.

The drum and piston shape shown in FIG. 2 is advantageous from the standpoint of providing a good seal because there is a continuous curved surface geometry and no flat at the top of the piston.

Figure 5:
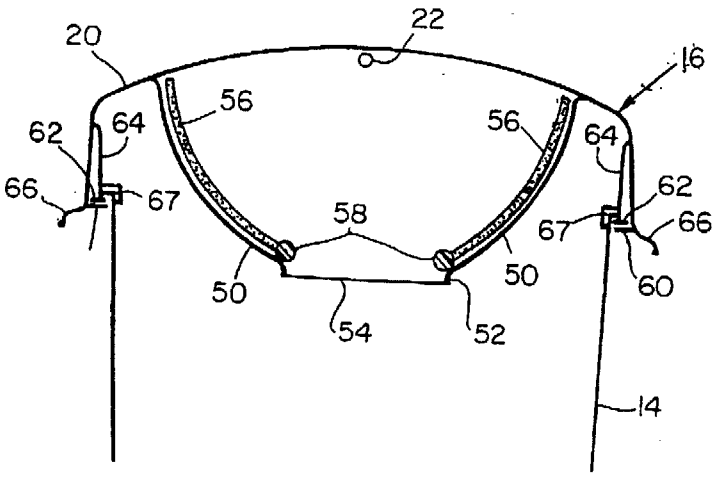
FIG. 5 is a cutaway side view of a lid for use with the diaper pail shown in FIG. 1.

As shown in FIG. 5, lid 20 includes a funnel-shaped shroud 50. Shroud 50 is shaped and located so that as drum 18 rotates about axis 23 (hinge joint 22), the gap between the curved section of drum 18 and shroud 50 remains essentially uniform. A snout or lip 52 encircles a hole 54 at the base of shroud 50, projecting away from drum 18 into the interior of container 14. A foam sheet 56 lining the surface of shroud 50, and/or a ring 58 surrounding hole 54, substantially seals the gap between drum 18 and shroud 50 to reduce the escape of vapors from container 14.

Lid 20 removably attaches to container 14 via a lip 60 extending around the circumference of lid 20. Lip 60 engages a flange 62 on a sleeve 64 at the top of container 14. Lid 20, which is made of, e.g., plastic, also includes two handles 66. Forcing handles 66 upward and outward flexes lid 20 sufficiently to disengage lip 60 from flange 62, allowing cover assembly 16 to be detached from container 14. A channel 67 at the base of sleeve 64 snaps over the top edge of container 14, allowing sleeve 64 to rotate with respect to container 14. Because lid 20 attaches to container 14 through flange 62 on sleeve 64, cover assembly 16 can thus be rotated with respect to container 14.

The operation of pail 10 is described with reference also to FIGS. 6A–6F. With cover assembly 16 removed, a plastic garbage bag 68 is placed into container 14, and the edges of bag 68 are draped over the outside surface of sleeve 64. Cover assembly 16 is then installed by pressing down on lid 20 and flexing it to cause lip 60 to engage flange 62, trapping bag 68 between cover assembly 16 and sleeve 64.

With bag 68 in place, a soiled diaper 12 is inserted into cylinder 32 in drum 18. Piston 38 prevents diaper 12 from dropping into container 14, and also (together with o-rings 40) prevents odors within container 14 from escaping through cylinder 32. Handle 26 is then manipulated to rotate drum 18 180°, until handle 26 is at the other side of cover assembly 16. When cylinder 32 aligns with hole 54, the combined weight of piston 38 and weight 42 forces diaper 12 though hole 54 and into bag 68. At this point, piston 38 is at the bottom of cylinder 32, and another diaper 12 may be disposed of by repeating the above-described process and using handle 26 to rotate drum 18 back to its original orientation. Throughout the disposal process (as well as before and after), seal 46 and ring seal 48 prevent odors within container 14 from escaping between drum 18 and shroud 50. Cover assembly 16 is thus a one-way valve that allows diaper 12 to be placed into container 14 without odor backflow or leakage.

Figure 6C:
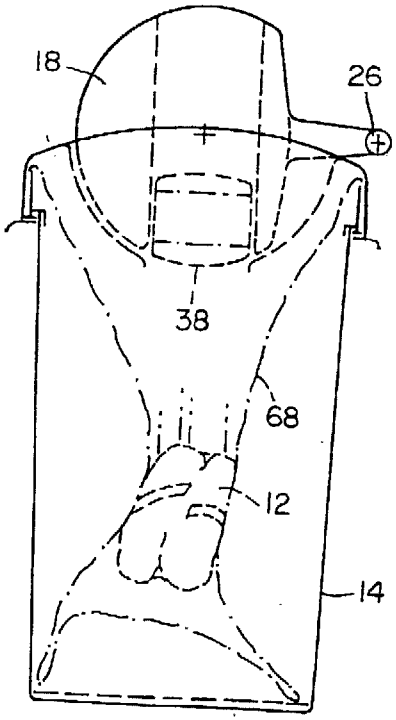
FIGS. 6A–6F are cutaway side views showing modes of operation of the diaper pail shown in FIG. 1.
Figure 6B:
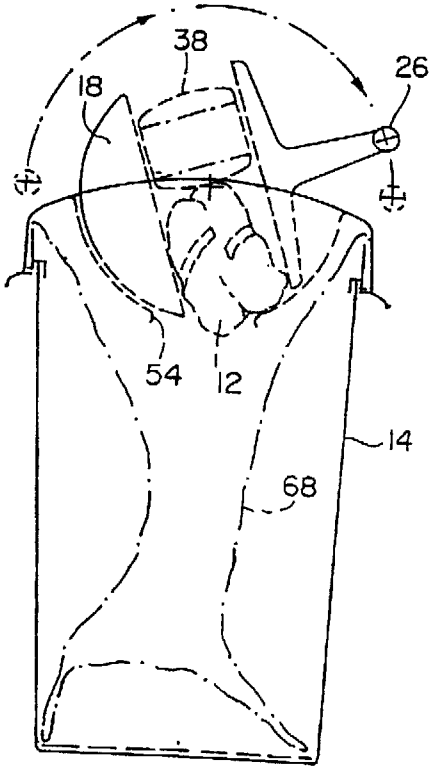
Figure 6A:
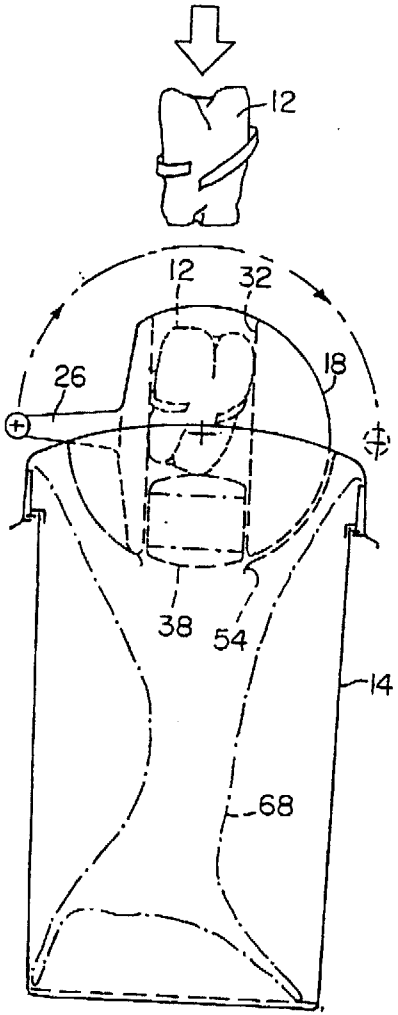
Figure 6F:
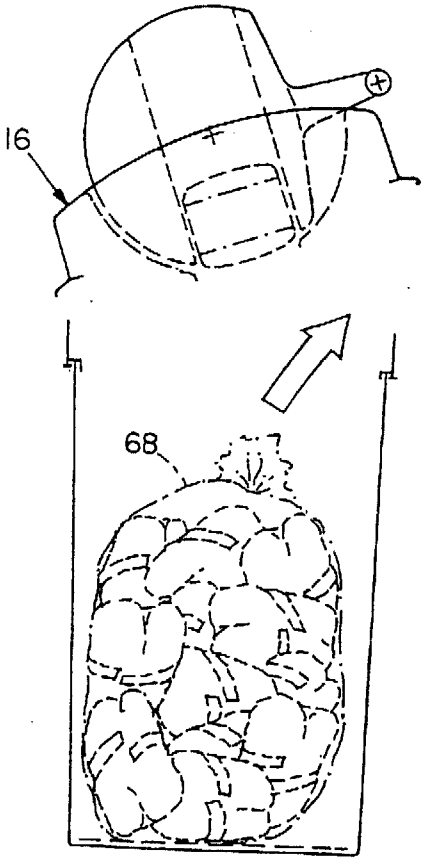
Figure 6E:
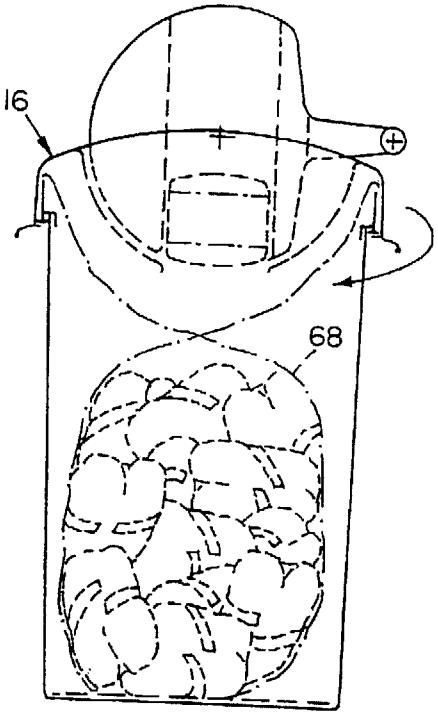
Figure 6D:
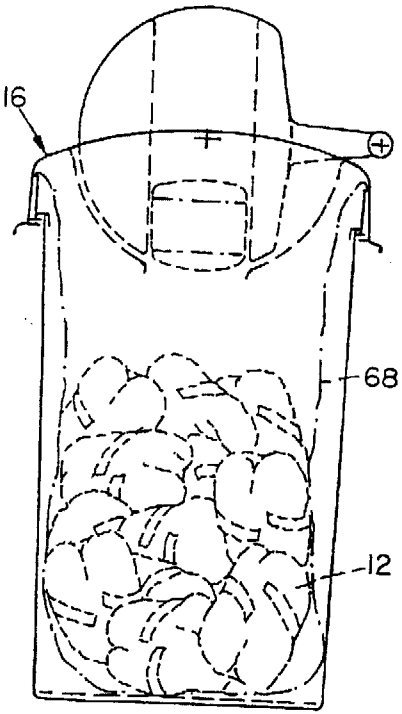

As depicted in FIGS. 6D–6F, when bag 68 is substantially filled with diapers 12 and it is desired to replace bag 68 with a fresh garbage bag, cover assembly 16 is rotated with respect to container 14. Because of the weight of diapers 12 in bag 68, rotating cover 16 causes the top portion of bag 68 (which is trapped between lid 20 and sleeve 64) to rotate with respect to the bottom portion, twisting bag 68 shut. After one or two revolutions, cover assembly 16 is detached and bag 68 is removed from container 14. Because bag 68 was twisted shut prior to the removal of cover assembly 16, very little odor escapes during the bag removal process.

Figure 7:
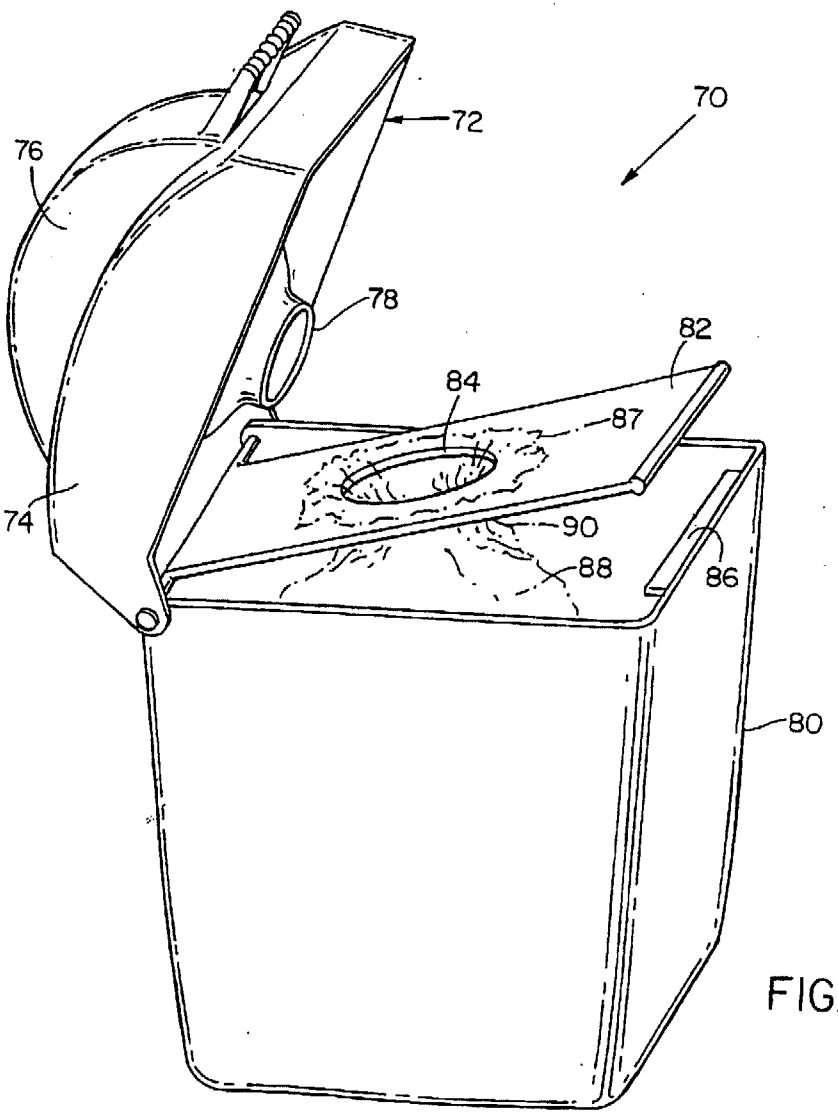
FIG. 7 is a perspective view of another diaper pail embodiment.

With reference now to FIG. 7, there is shown a perspective view of another embodiment of the invention, a pail 70 for disposing of and storing, e.g., soiled diapers. A cover assembly 72 includes a lid 74, a rotating drum 76, and a snout 78, all substantially as described above, but without a flat spot on the drum. Cover assembly 72 is hinged with respect to a container 80, but need not be hinged. Pail 70 further includes a bag retainer member 82. Bag retainer 82, which is hinged with respect to container 80 and cover 72, includes a hole 84. The diameter and location of hole 84 are selected such that snout 78 wedges into hole 84 when bag retainer 82 is rotated toward drum 76. A stop 86 prevents bag retainer 82 from swinging down into container 80.

Generally, the sizes and shapes of snout 78 and hole 84 are selected in accordance with the cross sectional area and shape of the object or objects to be deposited into container 80. In particular, snout 78 and hole 84 are sized and shaped so that, properly oriented, the object just passes through snout 78 (with some clearance to account for anticipated variation in size among objects of the same general type). The requisite cross section of snout 78 is therefore determined by the characteristic cross section of the object (e.g., the largest cross-section of the object along axis 33 when the object is placed into cylinder 32). Thus, because a rolled diaper is roughly a cylinder with a generally uniform circular cross section approximately 4 to 6 in. (10.16 to 15.24 cm.) in diameter, snout 78 and hole 84 are made round, with diameters of about 6 to 7 in. (15.24 to 17.78 cm.), just large enough to allow a single diaper 12 to pass through. An acceptable range of diameters is 2 to 11 inches.

In operation, the mouth 87 of a garbage bag 88 (shown in phantom for clarity) is gathered, threaded through hole 84, and splayed over the top surface of bag retainer 82. Because snout 78 and hole 84 are generally substantially smaller in diameter than the mouth of a typical garbage bag (which may be, e.g., 18 to 24 in.—45.72 to 60.96 cm.—in diameter, three to four times the diameters of snout 78 and hole 84), bag 88 necks down as it passes through hole 84. After bag 88 has been installed, cover assembly 72 is then rotated downward, until it engages the top lip of container 80, and snout 78 wedges into hole 84, trapping bag 88 in place. At this point, stop 86 prevents bag retainer 82 from swinging down into container 80. Cover assembly 72 is then operated as described above to dispose of soiled diapers (not shown).

Bag retainer 82 may be replaced by a smaller and/or nonhinged functionally similar part, including an elastic band to secure the bag to the snout.

When bag 88 is filled, cover assembly 72 and bag retainer 82 are rotated upward together. The necked-down portion 90 of garbage bag 88 is then squeezed by hand, twisted shut and/or tied off before bag retainer 82 is separated from cover assembly 72. Alternatively, because the necked-down portion 90 of bag 88 directly below bag retainer 82 is generally small in diameter, it may be grabbed with one hand and crushed closed to seal the bag opening. Bag retainer 82 is then separated from cover assembly 72 with the other hand to allow the filled bag 88 to be removed from container 80, all the while keeping necked-down portion 90 crushed closed to seal bag 88. Bag 88 can then be tied off and/or disposed of in a normal manner. Because bag 88 is never opened to atmosphere, essentially no odor escapes during the bag removal process.

Other embodiments are within the claims.

For example, although in the embodiments described herein the piston moves under the force of gravity, the piston may additionally or alternatively be manually actuated or be driven by a mechanism, such as a spring-driven actuator or any type of device that produces the requisite reciprocal or oscillating motion. Similarly, the drum need not be rotated manually. In addition, although described in connection with diaper disposal, the invention may be suitable for the disposal of other materials that emit harmful or unpleasant vapors, or for the disposal of sharps or other articles that cannot safely be stored in open, easily accessible containers. In general, the invention described herein may be useful in many applications in which it is desirable to pump or move a volume of material from one region to another.

Further, although in the embodiments described herein the drum is a semi-cylindrical section, it may be other shapes instead, such as spherical or partially spherical, and it need not have a circular or partially circular cross section along its axis of rotation. In addition, the cylinder in the rotating drum need only be open at one end. In such an embodiment, it may be desirable to vent the closed end of the cylinder to facilitate the motion of the piston.

Moreover, although bag retainer 82 is shown and described as a separate member pivotally attached to the container 80, other structures for attaching the mouth of bag 88 to snout 78, such as a rubber band or a ring, could alternatively be employed.

Figure 8:
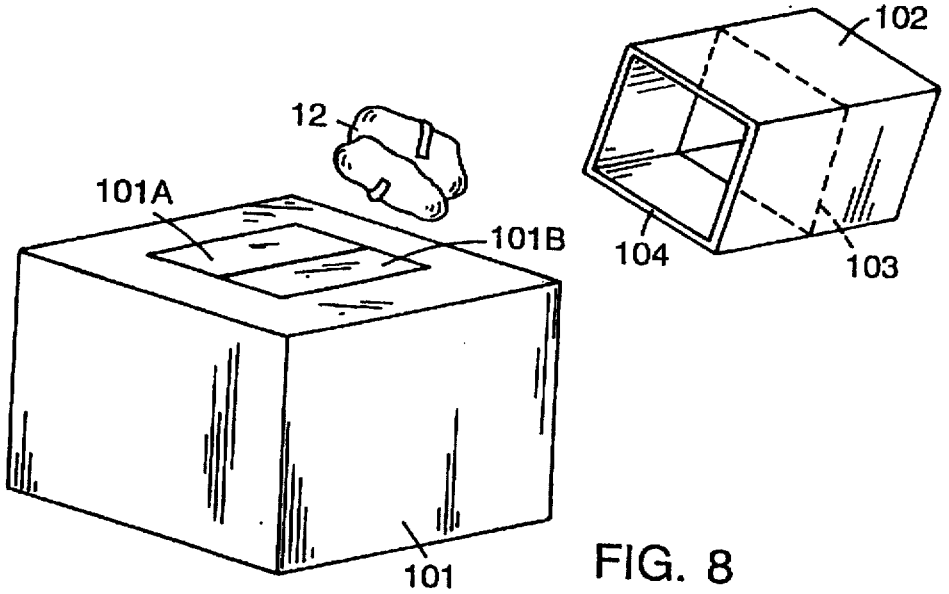
FIG. 8 is a pictorial exploded view of another embodiment of the invention showing a rectangular pail with a square hollow body.

Referring to FIG. 8, there is shown an exploded pictorial representation of another embodiment of the invention comprising a rectangular support structure or closed diaper pail 101 having hinged sealing doors 101A and 101B. A rectangular hollow body 102 of cross sectional area corresponding substantially to the opening covered by hinged doors 101A and 101B has a movable structure inside 103 and a gasket 104 at the bottom for sealing the opening covered by hinged doors 101A and 101B. Soiled diaper 12 may be placed in hollow body 102 below movable structure 103, hollow body 102 positioned over the opening covered by hinged doors 101A and 101B with gasket 104 sealing that opening. Moving movable structure 103 downward forces soiled diaper 12 into closed diaper pail 101 through hinged doors 101A and 101B, which return to the closed position shown to maintain the seal and prevent emission of odors from other soiled diapers in pail 101.

Figure 9:
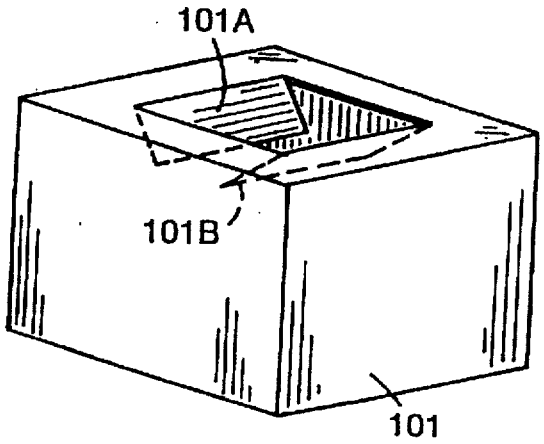
FIG. 9 shows the rectangular pail of FIG. 8 with the spring-loaded sealing doors depressed.

Referring to FIG. 9, there is shown a view of hinged doors 101A and 101B in a partially open position.

Figure 10:
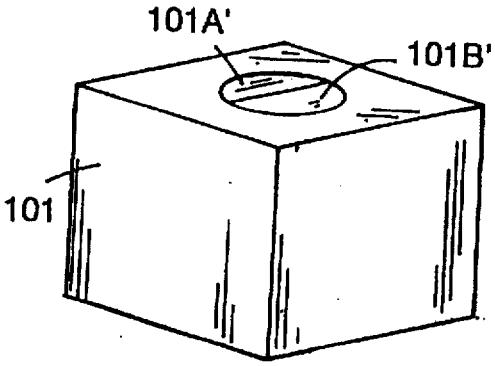
FIG. 10 shows an alternate form of seal that is slit-type with elastic material.

Referring to FIG. 10, there is shown a slit-type seal with elastic material 101A' and 101B' as an alternate construction which could be covered by a hollow body of elliptical or circular cross section.

Figure 11:
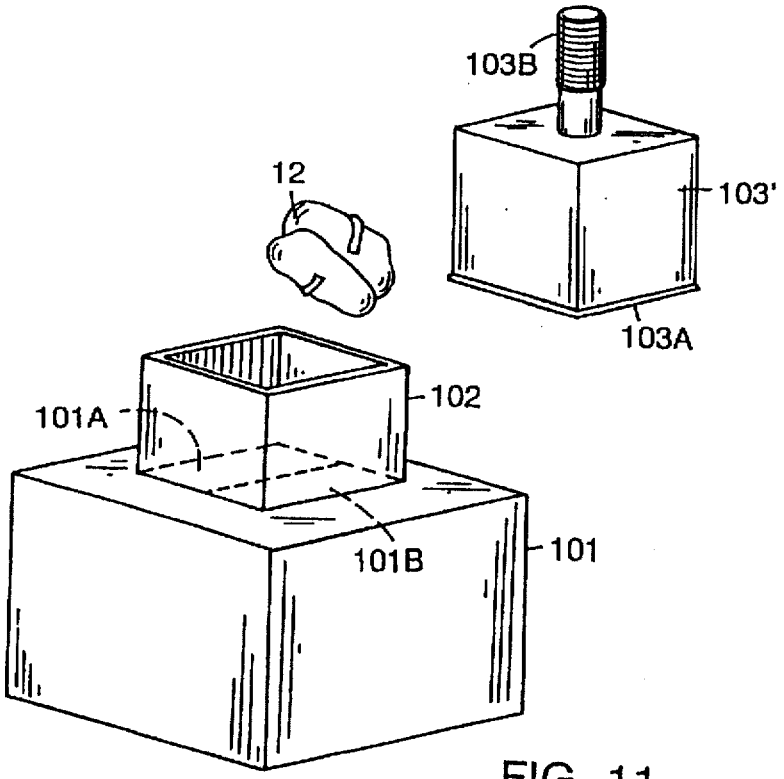
FIG. 11 is an exploded pictorial view of another embodiment of the invention having the hollow body seated on the rectangular pail.

Referring to FIG. 11, there is shown another alternate embodiment of the invention in which hollow body 103 is affixed to the top of pail 101 over the opening normally covered by hinged doors 101A and 101B. Diaper 12 is then placed in hollow body 102, the upward force maintaining spring-loaded doors 101A and 101B closed being sufficient to keep these doors closed with diaper 12 resting on them. Then movable structure 103' that is essentially a square piston having a gasket 103A at the bottom and a handle 103B at the top is placed in hollow body 102 and urged downward to force soiled diaper 12 through the opening covered by hinged doors 101A and 101B. Hinged doors 101A and 101B then close to restore the seal of the opening at the top while the gasketed square piston 103' prevents odors from escaping during the short interval in which hinged doors 101A and 101B open.

Figure 12:
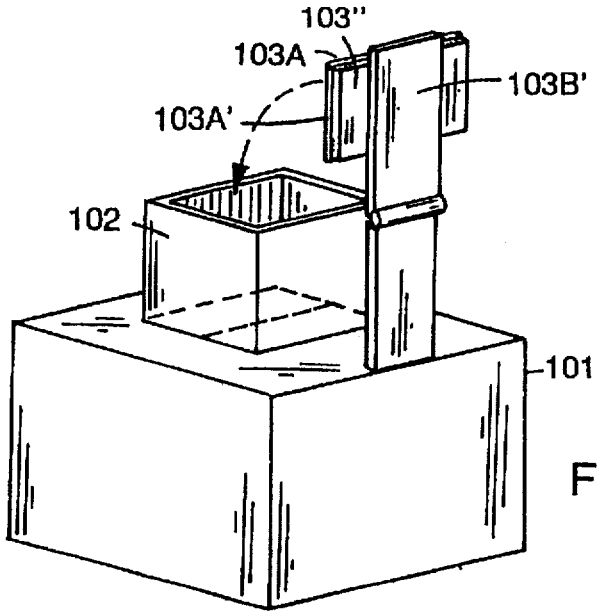
FIG. 12 is a variation of the embodiment of FIG. 11 having a hinged handle for moving the movable structure into the hollow body.

Referring to FIG. 12, there is shown a diagrammatic representation of a variation of the embodiment of FIG. 11 in which a square piston 103" is supported by a hinged handle 103B' and has a gasket 103A at the bottom. A soiled diaper is placed in hollow body 102, and hinged handle 103B' is moved toward hollow body 102 so that square piston 103" forces the soiled diaper through the opening covered by hinged doors 101A and 101B.

Figure 13:
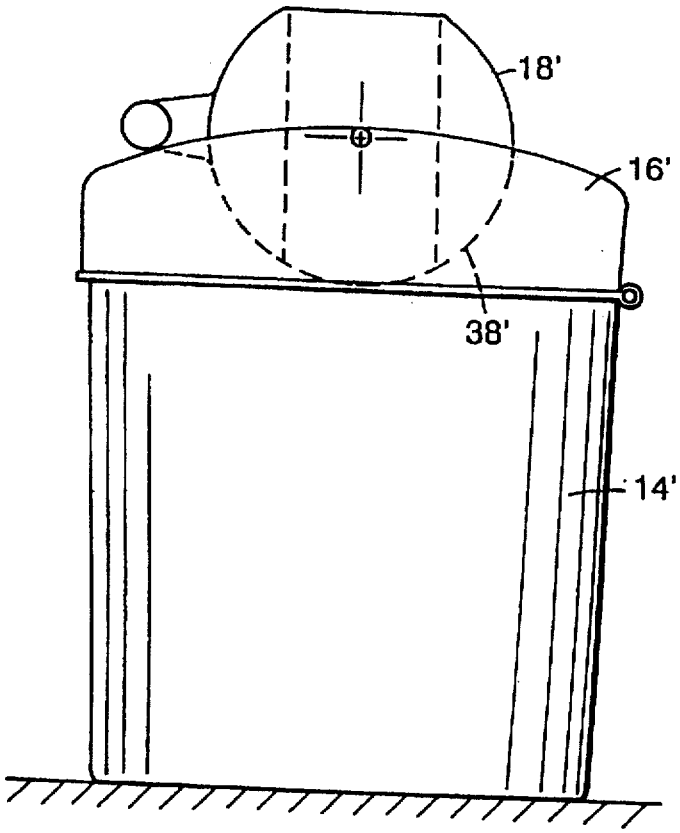
FIG. 13 is a diagrammatic representation of another embodiment of the invention in which sock-like structure performs the valving function of the sliding piston.
Figure 14:
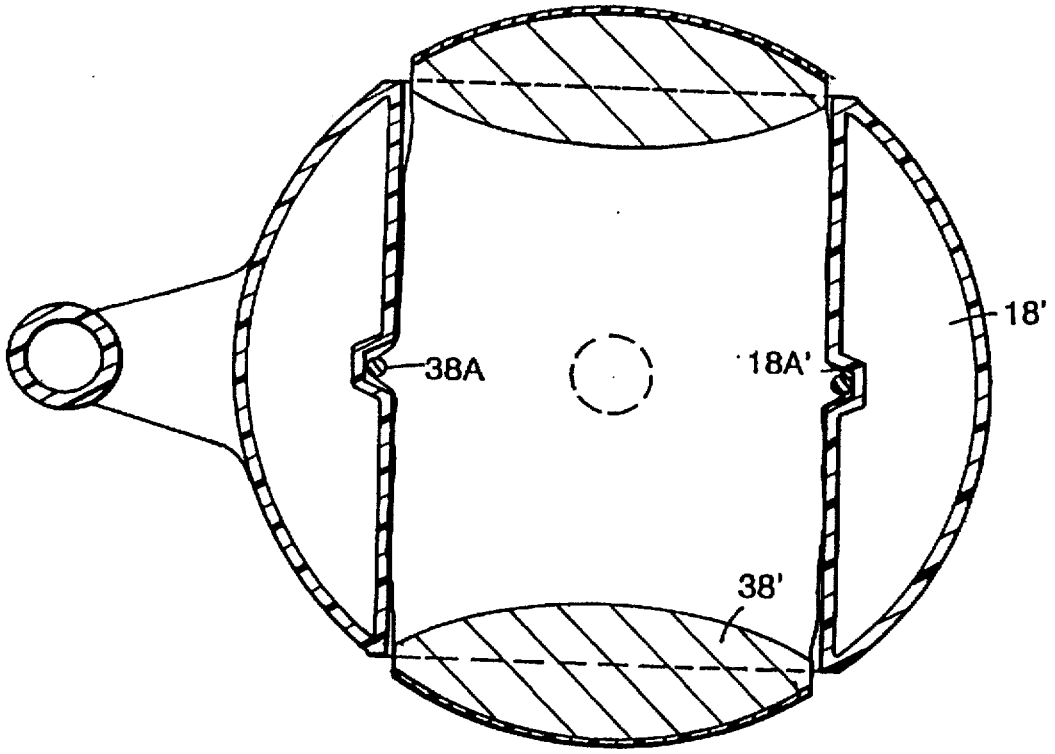
FIG. 14 is a detailed diagrammatic representation of the rotatable sphere with the sock-like valving member of FIG. 13.

Referring to FIG. 13, there is shown a variation of the embodiment of FIGS. 1 and 2 having container 14' and cover assembly 16' with drum 18' having a sock-like structure 38', better seen in FIG. 14, instead of piston 38.

Referring to FIG. 14, there is shown a diagrammatic representation of sock 38' seated in drum 18'. Sock 38' is secured by a snap-in PVC ring portion of sock 38' seated in an annular groove 18A' formed midway between the ends of the cylindrical opening in drum 18'. This embodiment of the invention functions in a manner similar to the embodiment in FIGS. 1 and 2. A soiled diaper may be placed in the cylindrical opening of drum 18' and in sock 38'. Rotating drum 18' 180° causes the soiled diaper to enter container 14' and the closed end of sock 38' to move downward to the formerly open end of the cylindrical opening, ready for receiving the next soiled diaper.

Figure 15:
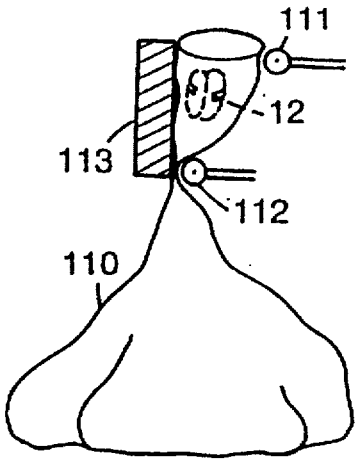
FIGS. 15–18 are diagrammatic representations of still another embodiment of the invention comprising a flexible bag and a pair of rollers at the top that perform the valving function.
Figure 16:
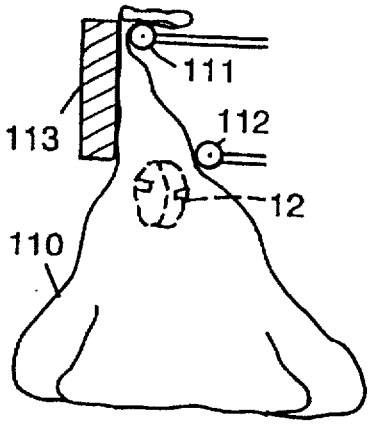
Figure 17:
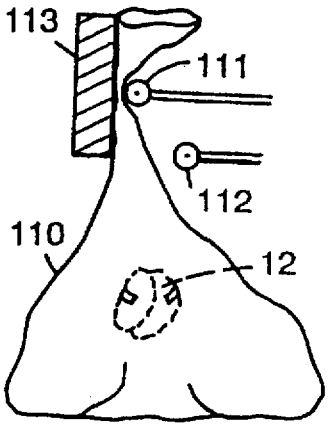
Figure 18:
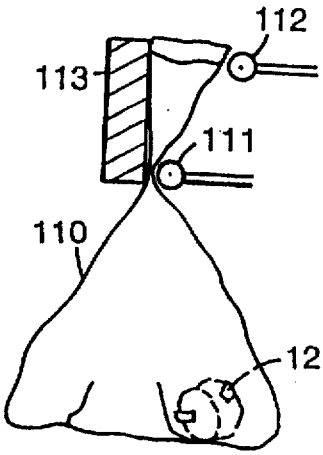

Referring to FIGS. 15–18, there is shown a pictorial representation of another embodiment of the invention comprising a bag 110, an upper roller 111, lower roller 112 and fixed base 113. FIG. 15 shows this embodiment ready for receiving soiled diaper 12 at the top with roller 112 sealing bag 110 against base 113 while upper roller 111 retracts to open the top of bag 110 to admit soiled diaper 12. FIG. 16 shows how roller 112 retracts allowing soiled diaper 12 to enter the lower storage portion of bag 110 while roller 111 presses against base 113 to close the top of bag 110 and prevent odors from escaping. FIG. 17 shows how roller 111 moves downward while pressed against base 113, allowing the upper portion of bag 110 to open without allowing odors to escape from the inside of bag 110. FIG. 18 shows roller 111 now occupying the position occupied by roller 112 in FIG. 15 with soiled diaper 12 resting on the bottom of bag 110 and roller 112 occupying the position roller 111 occupied in FIG. 15 ready to receive the next soiled diaper.

Figure 19:
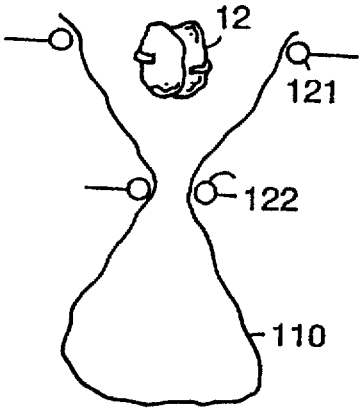
FIGS. 19–23 show a diagrammatic representation of still another embodiment of the invention comprising a flexible bag and a pair of squeezers at the top.
Figure 20:
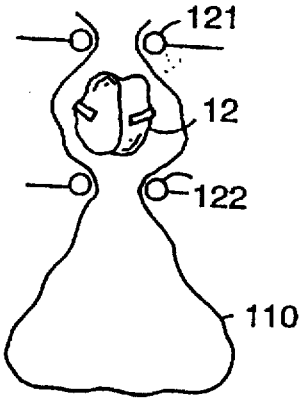
Figure 21:
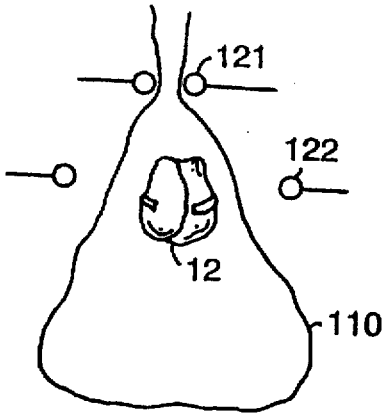
Figure 22:
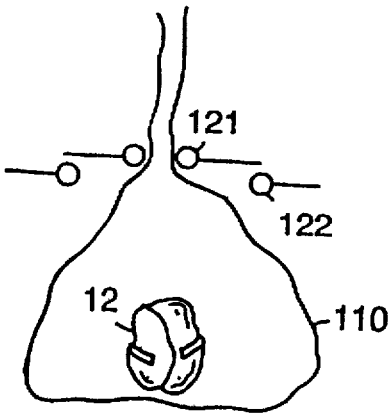
Figure 23:
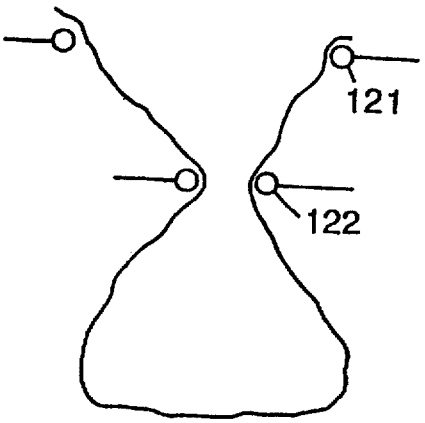

Referring to FIGS. 19–23, there are shown diagrammatic representations of another embodiment of the invention using a flexible bag 110 and a pair of squeezers 121 and 122. FIG. 19 shows squeezer 122 pinching bag 110 to keep odors in while squeezer 121 has its elements separated to open bag 110 at the top and allow soiled diaper 12 to enter. FIG. 20 shows squeezer 121 now closing. FIG. 21 shows squeezer 122 open while squeezer 121 closes to allow soiled diaper 12 to fall toward the bottom of bag 110 while squeezer 121 moves down. FIG. 22 shows squeezer 122 open, diaper 12 at the bottom of bag 110 and squeezer 121 still closed but in a plane just above that of squeezer 122. FIG. 23 shows squeezer 122 again closed and squeezer 121 again open and moved back to its original position shown in FIG. 19 with the apparatus ready to receive another soiled diaper.

Figure 24:
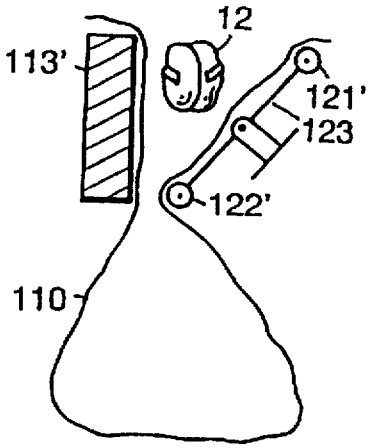
FIGS. 24–27 show a diagrammatic representation of a variation of the embodiment of FIGS. 19–23 showing an alternate squeeze structure.
Figure 25:
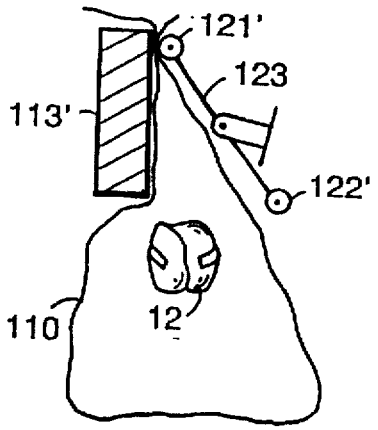
Figure 26:
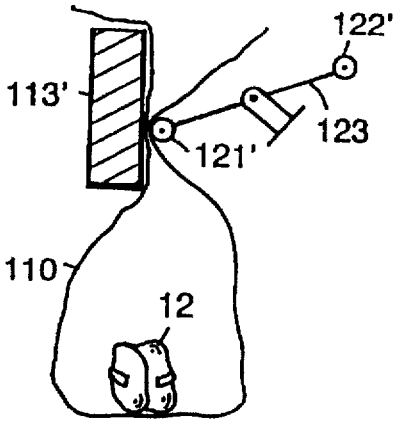
Figure 27:
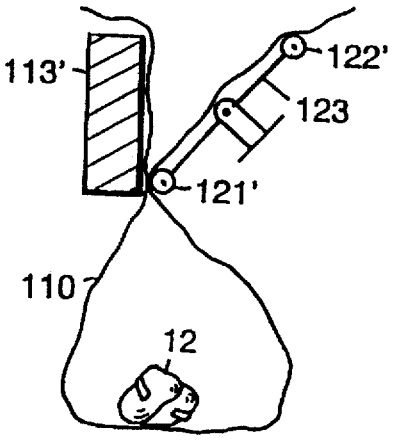

Referring to FIGS. 24–27, there is shown a variation of the embodiment of FIGS. 19–23 with alternate squeezers. Squeezers 121' and 122' are supported on opposite ends of rotating arm 123 to selectively squeeze the upper portion of bag 110 against base 113'. FIG. 24 shows squeezer 122' urging an intermediate portion of bag 110 against the lower portion of base 113' with squeezer 121' retracted from the upper portion of base 113' to open the top of bag 110 for admitting soiled diaper 12. FIG. 25 shows squeezer 121' sealing the top of bag 110 against the top of base 113' while squeezer 122' retracts from base 113' to allow soiled diaper 12 to move toward the bottom of bag 110 after counterclockwise movement of arm 123. FIG. 26 shows squeezer 121' closing bag 110 further down against base 113' after further clockwise rotation of arm 123 with diaper 12 at the bottom of bag 110. FIG. 27 shows squeezer 121' squeezing an intermediate portion of bag 110 closed against base 113' after further counterclockwise rotation of arm 123 to the position occupied by squeezer 122' in FIG. 24 while squeezer 122' occupies the position of squeezer 121' in FIG. 24 to open the top of bag 110 ready for receiving another soiled diaper.

The translation of the squeezed portion of bag 110 downward with the apparatus of FIGS. 15–27 provides a pumping action analogous to a peristaltic pump that tends to urge odors downward into the bag and prevent them from escaping through the opening in the top.

What is claimed is:

1. An odorless diaper pail comprising:

a housing having an aperture which opens into an interior chamber suitable for storing soiled diapers;

a door movably mounted to the housing within said aperture, said door comprising two door sections pivotably connected to the housing, the two door sections having leading edge portions which meet generally in the middle of said aperture, said door sections being movable between an open position and a closed position, said door sections being biased to said closed position to substantially close the aperture;

means for forming an upwardly opening receptacle for receiving and holding a diaper on top of said door; and a pushing member connected to the housing by a hinge, said pushing member having a pushing surface for engaging the diaper being held on top of said door and pushing said diaper through said door, said pushing surface having a surface contour which is substantially the same as said door, said pushing member being movable between an open position wherein the top of the door is exposed for receiving a diaper thereon, an intermediate position wherein said pushing surface engages said means for forming an upwardly opening receptacle to form a substantially sealed pumping chamber between the top of said door and said pushing surface of said pushing member before said diaper is pushed through said door, and a closed position wherein the pushing member is locked in mating engagement with the housing so as to entirely close the aperture and prevent air from moving from said interior chamber to the outside of the housing, said diaper being pushed through said door as said pushing member is moved from said intermediate position to said closed position, said pumping chamber substantially entirely preventing air from exiting the interior chamber of the housing as the diaper is pushed through said door.

* * * * *